United States Patent [19]

Klyne

[11] Patent Number: 4,757,861

[45] Date of Patent: Jul. 19, 1988

[54] OIL WELL SUCKER ROD COUPLING ASSEMBLY

[76] Inventor: Albert A. Klyne, 168 Windermere Drive, Edmonton, Alberta, Canada

[21] Appl. No.: 82,149

[22] Filed: Aug. 6, 1987

[51] Int. Cl.[4] ..... E21B 17/10

[52] U.S. Cl. ..... 166/241; 175/323; 175/325

[58] Field of Search ..... 166/173, 176, 175, 291; 175/323, 325, 321, 320

[56] References Cited

U.S. PATENT DOCUMENTS

| | | | |
|---|---|---|---|
| 2,307,688 | 1/1943 | Larson | 166/176 |
| 2,690,934 | 10/1954 | Holcombe | 175/325 |
| 2,907,351 | 10/1959 | Rohrback et al. | 166/242 X |
| 3,528,499 | 9/1970 | Collett | 166/175 |
| 4,182,537 | 1/1980 | Oster | 166/176 X |
| 4,549,613 | 10/1985 | Case | 166/241 X |

*Primary Examiner*—Stephen J. Novosad

[57] ABSTRACT

A sucker rod coupling assembly is provided for connecting a pair of sucker rods and centralizing the rods in a tubing string. The coupling assembly finds particular application in connection with a rotating rod string driving an oil well downhole screw pump. The coupling assembly comprises a cylindrical solid steel shaft having externally threaded pin ends. A tubular sleeve or layer formed of non-metallic soft resilient abrasion-resistant material, such as polyurethane, is bonded to the surface of the shaft and extends its full length between the pin ends. A pair of internally threaded steel sucker rod box couplings is also provided. The box couplings are provided to interconnect the shaft with the pair of sucker rods. The shaft end face of each box coupling has a ring of soft resilient abrasion-resistant material bonded thereto. A tubular externally fluted centralizer, formed of the same material, fits loosely around the shaft. The centralizer has a snug fit in the tubing and is frictionally gripped so as to be stationary in use. One or more notches extend transversely across the upper end face of the centralizer, to permit fluid flow therethrough so that the centralizer does not seal against the coupling above it. The polyurethane layers on the shaft and coupling end faces protect the steel parts of the coupling assembly against severe abrasion wear from sand particles proceeding through the annular clearance between the centralizer and the shaft. By providing a non-rotating non-metallic centralizer at the locus of the large diameter box ends, wear of the tubing wall is substantially reduced.

5 Claims, 2 Drawing Sheets

OIL WELL SUCKER ROD COUPLING ASSEMBLY

FIELD OF THE INVENTION

The present invention relates to a coupling assembly for connecting and centralizing a pair of elongate threaded-end members, such as sucker rods, end to end.

BACKGROUND OF THE INVENTION

A sucker rod string is normally used in a pumped oil well to actuate the downhole pump. Such a string is made up of a multiplicity of sucker rods connected together end to end. Each such sucker rod comprises a solid steel cylindrical stem or rod, typically having a length of about 30 feet and a diameter of $\frac{5}{8}$ or $\frac{3}{4}$ inches. At each of its ends, the stem is provided with an upset or enlarged diameter portion having a threaded pin end.

A cylindrical internally threaded member, termed a "sucker rod coupling", is conventionally used to interconnect two sucker rods end to end. In this way, a "string" of sucker rods is built up or assembled.

The couplings are larger in outside diameter than the stem and the upset ends. Typically, a coupling has a diameter of $1\frac{7}{8}$".

The sucker rod string extends through and operates in a concentrically arranged tubing string. This tubing string is comprised of threaded-together steel tubes, typically each having a length of 30 feet and an inside diameter of $2\frac{1}{2}$ inches.

The rod string functions to actuate the downhole pump to force fluid to ground surface through the annular space defined between the rod and tubing strings. This actuation may occur as a result of reciprocating the rod string or, in the case where the downhole pump is of the screw type, rotating the rod string.

The present invention was developed in connection with rotating rod strings. It will be discussed herein in connection with the problems associated with such strings. However, the product can be used in reciprocating strings also.

The previously mentioned screw pumps are commonly used in connection with pumping heavy oil carrying a significant content of sand. Development of heavy oil reservoirs today commonly involves close spacing of the wells and drilling a number of the wells directionally from a single central "pad".

When the rod string is placed in such a well, it tends to assume a curvilinear configuration and it also tends to lie along the low side of the tubing. When the rod string is rotated to drive the pump, the longitudinally fixed but rotating couplings tend to slap and rub against the tubing wall. These actions, coupled with the erosive presence of sand trapped between the steel-on-steel coupling and tubing, can rapidly wear the tubing wall. In a "bad" well, where the well inclination, the longitudinally stationary positioning of the couplings, the relatively high speed rotation, and the presence of sand all combine to create an erosive environment, the rod string couplings can wear through the tubing wall in as little as two weeks. This result is disastrous for the well operation and requires expensive repairs.

It has long been conventional in the industry to centralize one string in another to keep them in spaced relation and out of contact. Commonly this has been done by mounting relatively large diameter annular bodies or 'stabilizers' on the inner string at spaced points along its length.

SUMMARY OF THE INVENTION

The present invention originated from an effort to develop a sucker rod coupling assembly which would significantly reduce wear of the tubing wall by the sucker rod couplings.

Applicant's initial concept involved the following:

using a fluted centralizer body which would closely fit the tubing so as to frictionally engage the latter and remain substantially stationary, while still permitting the fluid production to move up the wellbore;

locating the centralizer at the joining point of two sucker rods, to ensure that the large diameter rotating steel coupling would be kept out of contact with the tubing wall (which would not necessarily be the case if the centralizer body were mounted on the sucker rod stem);

forming the centralizer body of non-abrasive material, such as polyurethane, to ensure that it would not wear the tubing wall if it rotated; and using two couplings spaced apart by a reduced diameter shaft, said three components being interconnected end to end to form an assembly that would not only join the adjacent ends of two sucker rods but would also provide a rotating support for the centralizer body at the locus of the couplings.

Applicant's first prototype involved two steel couplings, a reduced diameter steel shaft, and a tubular fluted polyurethane centralizer body. One coupling was provided with a pin end and the other with a box end. The shaft was provided with a pin end and a box end, for threaded connection with the aforementioned ends of the two couplings. When several units of this design were tested, it was found that the new assembly had a longer life (in the order of 3 months) than would have been expected for a coupling alone, but the following problem was noted:

Sand and wax would penetrate into the small annular clearance between the stationary centralizer and the rotating shaft. This tightly held sand would rapidly wear the steel of the shaft against which it pressed. Failure would then first occur at the relatively thin-walled box end of the shaft.

In the next design, applicant used a solid (non-bored) shaft and provided the couplings with box ends. These units were tested and found to have a life of about 6 months. But sand wear of the shaft's longitudinal surface and at the end face of the upper coupling were still noted to be severe.

At this point, applicant reduced the diameter of the shaft and built up a tubular cylindrical sleeve of polyurethane bonded thereto, to form a composite integral unit. In addition, applicant built up a ring of polyurethane on the end surfaces of each of the two couplings, said ring being bonded to the coupling involved. Units in accordance with this design were tested and found to be relatively free of wear after 6 months.

So, further to the original concept, the following features had now been added to yield a much improved product:

preferably utilizing a solid shaft equipped with threaded pin ends;

and bonding a protective layer of relatively soft, non-metallic, resilient, abrasion-resistant material to the rotating steel surfaces of the coupling-shaft assembly, which surfaces would be exposed to contact with tightly held sand particles.

Broadly stated, the invention therefore is a coupling assembly for connecting and centralizing a pair of elongate threaded-end members, comprising: a pair of steel box couplings; a steel shaft connected to and extending between the couplings, said shaft having a diameter less than that of the couplings; said shaft having a tubular cylindrical sleeve of resilient abrasion-resistant non-metallic material bonded thereto and covering its surface between the couplings to form an integral unit therewith; each such coupling having a ring of resilient abrasion-resistent non-metallic material bonded to and substantially fully covering the coupling's end face which is adjacent to the shaft; and a tubular externally fluted centralizer body mounted on the shaft and encircling the latter, said centralizer body extending radially outwardly beyond the longitudinal surfaces of the couplings, said centralizer body being formed of resilient abrasion-resistant non-metallic material.

DESCRIPTION OF THE PREFERRED EMBODIMENT

Figure 1:
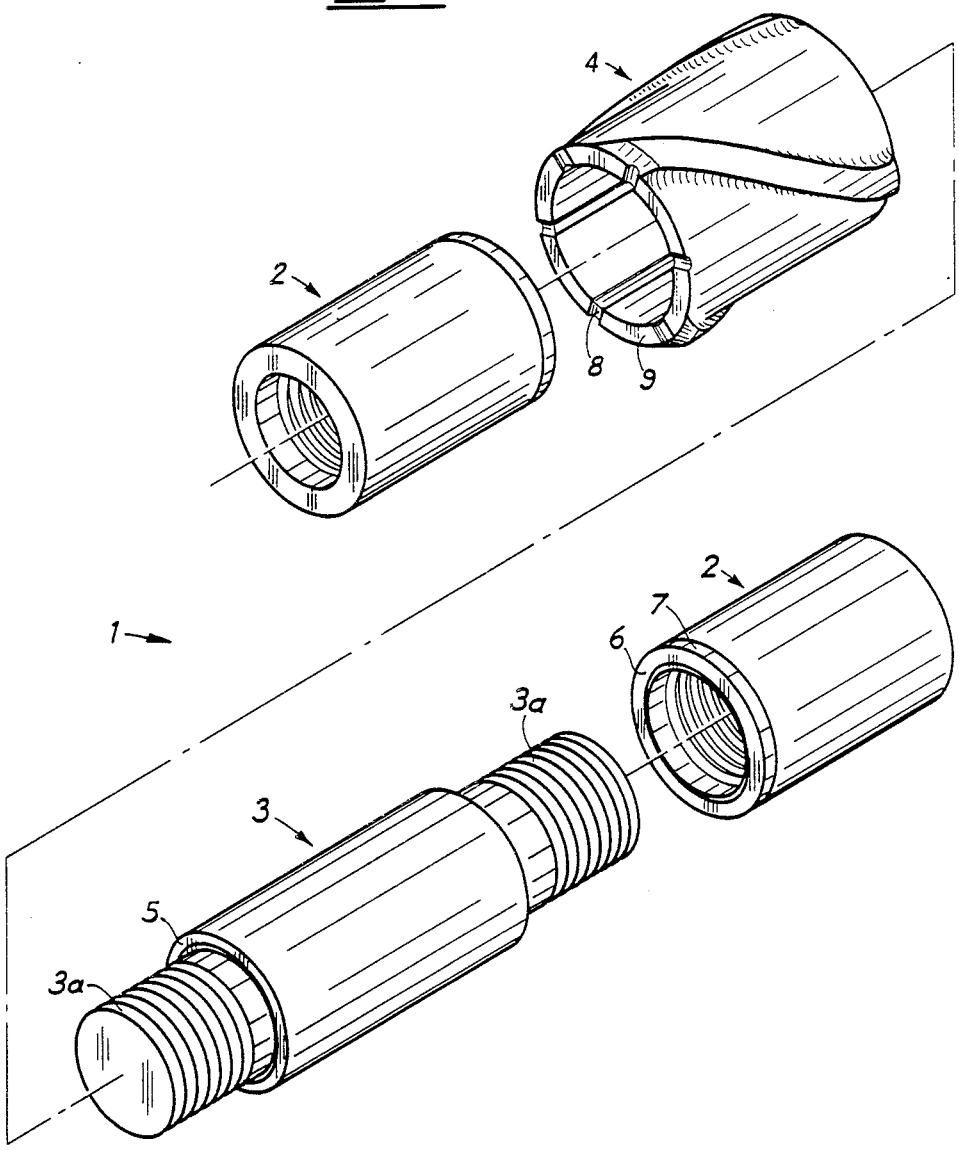
FIG. 1 is an exploded perspective view of the coupling assembly.
Figure 2:
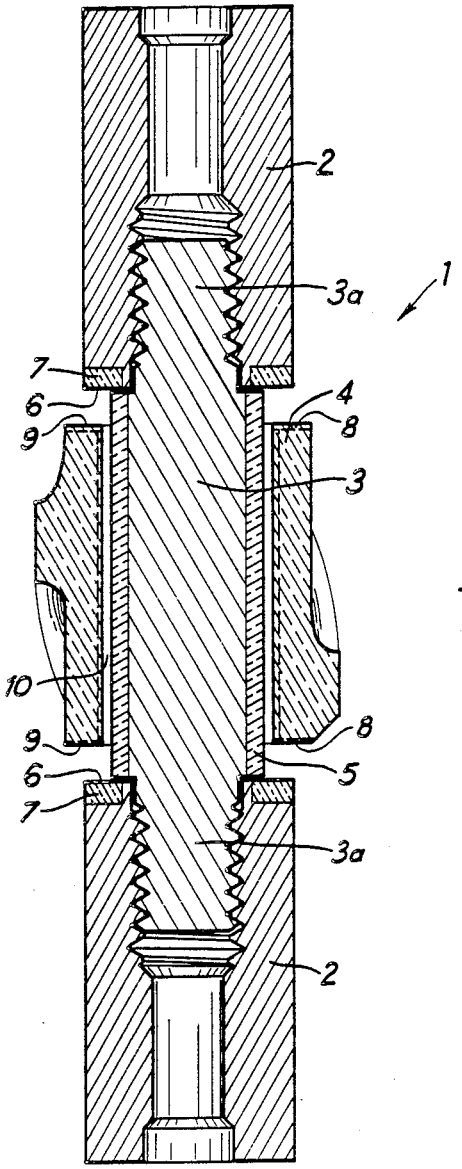
FIG. 2 is a side sectional view of the coupling assembly screwed together and ready for use.

The coupling assembly 1 comprises a pair of steel box end sucker rod couplings 2, a steel shaft 3 having threaded pin ends 3*a*, and a tubular centralizer body 4.

The couplings 2 are conventional internally threaded box end couplings adapted to connect with the threaded pin end of a sucker rod (not shown).

The shaft 3 has a tubular cylindrical sleeve 5 of soft resilient non-metallic abrasion-resistant material bonded thereto. The sleeve 5 circumscribes the shaft and extends between its pin ends 3*a*. Preferably, the sleeve 5 may be formed of polyurethane having a hardness in the range 10A to 70D, as established by the ASTM D 2240 −81 hardness test. Typically, the sleeve may have a thickness of $\frac{1}{8}$ inch.

The coupling end faces 6 adjacent to the shaft 3 each have a soft resilient non-metallic abrasion-resistant ring 7 bonded thereto. The rings may suitably be formed of the same material as that used to coat the shaft and may have the same thickness.

The centralizer body 4 is formed of soft resilient non-metallic abrasion-resistant material, similar to that used to coat the shaft 3 and coupling end faces 6. The centralizer body is sized to have about a $\frac{1}{4}$ inch clearance about the shaft 3 and to just frictionally engage the tubing in which it is to be used. It is externally fluted as shown. Notches 8 are formed transversely across the upper end face 9 of the centralizer body 4, to allow fluid to move through the annular space 10 between the centralizer body 4 and the composite shaft 3, 5 when the body is abutting the upper coupling 2.

When assembled, the couplings 2 and the composite shaft 3, 5 form an integral rotating part of the rod string. The centralizer body 4 is generally stationary in the tubing and functions to space the couplings 2 from the tubing wall. The bonded polyurethane sleeves and rings 5, 7 prevent sand from reaching and abrading the steel surfaces of the shaft and coupling end faces.

It is contemplated that a coupling assembly as described could be used in other wellbore strings, such as a drilling string.

The scope of the invention is defined by the claims now following.

The embodiments of the invention in which an exclusive property or privilege is claimed are defined as follows:

1. A coupling assembly for connecting and centralizing a pair of elongate threaded-end members, comprising:

a pair of steel box couplings;

a steel shaft connected to and extending between the couplings, said shaft having a diameter less than that of the couplings;

said shaft having a tubular cylindrical sleeve of resilient abrasion-resistant non-metallic material bonded thereto and covering its surface between the couplings to form an integral unit therewith;

each such coupling having a ring of resilient abrasion-resistant non-metallic material bonded to and substantially fully covering the coupling's end face which is adjacent to the shaft; and a tubular externally fluted centralizer body mounted on the shaft and encircling the latter, said centralizer body extending radially outwardly beyond the longitudinal surfaces of the couplings, said centralizer body being formed of resilient abrasion-resistant non-metallic material.

2. A sucker rod coupling assembly for connecting a pair of sucker rods and centralizing them in a tubing string, comprising:

a pair of steel sucker rod box couplings;

a steel shaft connected to and extending between the couplings, said shaft having a diameter less than that of the couplings;

said shaft having a tubular cylindrical sleeve of resilient abrasion-resistant non-metallic material bonded thereto and covering its surface between the couplings to form an integral unit therewith;

each such coupling having a ring of resilient abrasion resistant non-metallic material bonded to and substantially fully covering the coupling's end face which is adjacent to the shaft; and a tubular externally fluted centralizer body mounted on the shaft and encircling the latter, said centralizer body extending radially outwardly beyond the longitudinal surfaces of the couplings, said centralizer body being formed of resilient abrasion-resistant non-metallic material.

3. The assembly as set forth in claim 2 wherein:

the centralizer body extends substantially the full length of the shaft and sleeve unit and extends radially outwardly sufficiently so as to frictionally engage the tubing in which it is to be used.

4. The assembly as set forth in claim 3 wherein:

the sleeve, rings and centralizer body are formed of polyurethane.

5. The assembly as set forth in claim 3 wherein:

the sleeve, rings and centralizer body are formed of polyurethane having a hardness in the range of 10A to 70D.

* * * * *